US009341430B2

(12) United States Patent
McPherson

(10) Patent No.: US 9,341,430 B2
(45) Date of Patent: May 17, 2016

(54) SELF-ALIGNING CROSSBOW INTERFACE

(71) Applicant: MCP IP, LLC, Sparta, WI (US)

(72) Inventor: Mathew A. McPherson, Norwalk, WI (US)

(73) Assignee: MCP IP. LLC, Sparta, WI (US)

( * ) Notice: Subject to any disclaimer, the term of this patent is extended or adjusted under 35 U.S.C. 154(b) by 48 days.

(21) Appl. No.: 14/021,655

(22) Filed: Sep. 9, 2013

(65) Prior Publication Data

US 2014/0069401 A1 Mar. 13, 2014

Related U.S. Application Data

(60) Provisional application No. 61/699,244, filed on Sep. 10, 2012.

(51) Int. Cl.
*F41B 5/12* (2006.01)
*F41B 5/14* (2006.01)

(52) U.S. Cl.
CPC .... *F41B 5/12* (2013.01); *F41B 5/14* (2013.01)

(58) Field of Classification Search
CPC ..... F41B 5/12; F41B 5/123; F41B 5/14
USPC ..... 124/25
See application file for complete search history.

(56) References Cited

U.S. PATENT DOCUMENTS 214,791 A * 4/1879 Randall ..... F41B 5/12 124/25
480,879 A 8/1892 Stevenson
577,641 A 2/1897 Bruder
RE13,844 E 12/1914 Sawyer
1,371,619 A 3/1921 Greenstreet
2,500,509 A 3/1950 Bailey
2,609,810 A * 9/1952 Gruner ..... F41B 5/12 124/25
2,814,284 A * 11/1957 Sileo ..... F41B 5/12 124/25
2,842,114 A * 7/1958 Duncan ..... F41B 5/12 124/25
3,161,189 A 12/1964 Chessman
3,224,427 A * 12/1965 Ronan ..... F41B 5/12 124/25
3,269,380 A * 8/1966 Stevens ..... F41B 5/12 124/25
3,483,857 A * 12/1969 Jones ..... F41B 5/12 124/25
3,486,495 A 12/1969 Allen
3,581,729 A * 6/1971 Jones ..... F41B 5/12 124/25
3,968,783 A * 7/1976 Pfotenhauer ..... F41B 7/006 124/25
4,178,905 A 12/1979 Groner
4,206,740 A * 6/1980 Lydon ..... F41B 5/12 124/25
4,261,320 A 4/1981 Barna
4,294,222 A * 10/1981 Pelsue ..... F41B 5/12 124/25
4,545,358 A * 10/1985 Collins ..... F41B 5/12 124/25
4,574,766 A 3/1986 Izuta (Continued)

OTHER PUBLICATIONS

U.S. Appl. No. 61/256,844, filed Oct. 30, 2009; Inventor: Mathew A. McPherson.

(Continued)

*Primary Examiner* — Alexander Niconovich

(57) ABSTRACT

In some embodiments, a crossbow comprises a bow portion defining a first central vertical axis and a stock portion defining a second central vertical axis. The bow portion comprises an interfacing portion and the stock portion comprises a complimentary interfacing portion. The interfacing portion and the complimentary interfacing portion are arranged to provide self-alignment of the stock portion with the bow portion, such that the first central vertical axis and the second central vertical axis are coaxial.

20 Claims, 10 Drawing Sheets

(56) References Cited

U.S. PATENT DOCUMENTS

D283,637 S 4/1986 Williams
4,587,944 A * 5/1986 Barnett ..... F41B 5/12 124/25
4,594,994 A * 6/1986 Williams ..... F41B 5/12 124/25
4,644,929 A 2/1987 Peck
4,649,891 A 3/1987 Bozek
4,649,892 A * 3/1987 Bozek ..... F41B 5/10 124/25
4,674,468 A 6/1987 Izuta
4,693,228 A 9/1987 Simonds et al.
4,699,117 A * 10/1987 Waiser ..... F41B 5/12 124/25
4,711,228 A * 12/1987 Gillespie ..... F41B 5/123 124/24.1
4,716,880 A * 1/1988 Adkins ..... F41B 5/12 124/25
4,722,318 A 2/1988 Yankey
H486 H 7/1988 Savioli
4,879,987 A 11/1989 Nishioka
4,926,834 A * 5/1990 Chauvin ..... F41B 5/12 124/25
4,942,861 A * 7/1990 Bozek ..... F41B 5/12 124/25
5,025,774 A 6/1991 Martin
5,099,819 A 3/1992 Simonds et al.
5,119,797 A * 6/1992 Anderson ..... F41B 5/143 124/24.1
5,172,679 A 12/1992 Mussack
5,231,970 A 8/1993 Ploot et al.
5,280,779 A 1/1994 Smith
5,339,790 A 8/1994 Smith
5,368,006 A 11/1994 McPherson
5,408,982 A 4/1995 Doornenbal
5,411,008 A 5/1995 Hsu
5,429,106 A 7/1995 Martin et al.
5,433,792 A 7/1995 Darlington
5,464,001 A 11/1995 Peck
5,487,373 A 1/1996 Smith
5,507,270 A 4/1996 Smith
5,515,836 A 5/1996 Martin et al.
5,522,373 A * 6/1996 Barnett ..... F41B 5/12 124/23.1
5,546,923 A 8/1996 Duncan
5,553,596 A * 9/1996 Bednar ..... F41B 5/1426 124/25
5,592,929 A 1/1997 Hoyt, Jr.
5,660,158 A 8/1997 Rudolph
5,697,355 A 12/1997 Schaffer
5,697,358 A 12/1997 Campisi
5,720,267 A 2/1998 Walk
5,722,380 A 3/1998 Land et al.
5,823,172 A * 10/1998 Suggitt ..... F41B 5/12 124/25
5,947,099 A 9/1999 Derus
6,024,076 A 2/2000 Laborde et al.
6,244,259 B1 6/2001 Adkins
6,257,220 B1 7/2001 McPherson et al.
6,267,108 B1 7/2001 McPherson et al.
6,360,734 B1 3/2002 Andrews
6,371,098 B1 4/2002 Winther
6,470,870 B1 10/2002 Schaar
6,543,432 B2 4/2003 Andrews et al.
6,560,911 B2 5/2003 Sharp
6,571,785 B1 6/2003 Choma
6,651,641 B1 11/2003 Bower et al.
6,712,057 B2 3/2004 Andrews
6,786,214 B2 9/2004 Andrews
6,886,549 B2 5/2005 McPherson
6,941,937 B2 9/2005 Wheeler
6,964,271 B2 11/2005 Andrews
7,025,051 B1 4/2006 Gallops, Jr.
7,077,116 B1 7/2006 Darlington
7,174,884 B2 2/2007 Kempf et al.
7,178,514 B2 * 2/2007 Chang ..... F41B 5/1426 124/25
7,308,890 B1 12/2007 Wheeler
7,328,693 B2 2/2008 Kempf
7,334,575 B2 2/2008 McPherson
7,363,921 B2 4/2008 Kempf
7,584,750 B2 9/2009 Chang
7,624,724 B2 * 12/2009 Bednar ..... F41B 5/123 124/25
7,708,001 B2 5/2010 Kempf
7,823,572 B2 * 11/2010 Anderson ..... F41B 5/123 124/25
7,832,386 B2 * 11/2010 Bednar ..... F41B 5/105 124/25
7,836,871 B2 11/2010 Kempf
7,918,218 B1 4/2011 Kronengold et al.
7,930,849 B2 4/2011 Abraham et al.
7,938,108 B2 * 5/2011 Popov ..... F41B 5/123 124/25
8,033,275 B2 * 10/2011 Bednar ..... F41B 5/123 124/25
8,042,530 B2 * 10/2011 Barnett ..... F41B 5/12 124/23.1
8,047,189 B2 11/2011 McPherson
8,069,847 B2 12/2011 Blosser
8,225,777 B2 * 7/2012 Chu ..... F41B 5/123 124/25
8,434,463 B2 * 5/2013 Bednar ..... F41B 5/123 124/25
8,453,635 B1 6/2013 McPherson
8,479,719 B2 * 7/2013 Bednar ..... F41B 5/105 124/25
8,627,811 B1 * 1/2014 Darlington ..... F41B 5/1426 124/25
8,656,899 B2 * 2/2014 Bednar ..... F41B 5/12 124/25
8,701,641 B2 * 4/2014 Biafore, Jr. ..... F41B 5/123 124/25
8,701,642 B2 * 4/2014 Biafore, Jr. ..... F41B 5/123 124/25
8,763,595 B1 * 7/2014 Bednar ..... F41B 5/105 124/25
8,794,224 B2 * 8/2014 Bednar ..... F41B 5/12 124/25
8,794,225 B2 * 8/2014 Bednar ..... F41B 5/105 124/25
8,991,380 B2 * 3/2015 Bednar ..... F41B 5/12 124/25
9,121,659 B1 * 9/2015 Chang ..... F41B 5/123
2002/0020403 A1 2/2002 Troubridge
2003/0084893 A1 5/2003 Andrews
2004/0077440 A1 4/2004 Kronfeld
2005/0279338 A1 12/2005 Dziekan
2007/0101631 A1 5/2007 Bentley
2007/0289190 A1 12/2007 Oz
2008/0072888 A1 3/2008 Chang
2008/0127956 A1 * 6/2008 Bednar ..... F41B 5/123 124/25
2008/0127961 A1 6/2008 McPherson
2008/0156310 A1 7/2008 Leven
2008/0168969 A1 7/2008 Kempf
2008/0236557 A1 10/2008 Budd
2009/0071457 A1 3/2009 Gordon et al.
2009/0071458 A1 3/2009 Gordon et al.
2009/0145411 A1 6/2009 Sims et al.
2009/0178658 A1 * 7/2009 Barnett ..... F41B 5/12 124/25
2009/0194086 A1 8/2009 Kempf
2009/0241928 A1 10/2009 Blosser
2010/0116259 A1 * 5/2010 Popov ..... F41B 5/123 124/25
2010/0186728 A1 7/2010 Bednar et al.
2010/0263650 A1 10/2010 Dahl, II et al.
2010/0269807 A1 10/2010 Kempf

(56) References Cited

U.S. PATENT DOCUMENTS

2011/0016764 A1 1/2011 Cales
2011/0203561 A1* 8/2011 Shaffer ..... F41B 5/105 124/25
2011/0232619 A1* 9/2011 Bednar ..... F41B 5/1469 124/86
2013/0213373 A1* 8/2013 Biafore, Jr. ..... F41B 5/12 124/25

OTHER PUBLICATIONS

Jennings Archery, Advertisement, FNT(TM) Limbs, Date Unknown.

* cited by examiner

SELF-ALIGNING CROSSBOW INTERFACE

CROSS-REFERENCE TO RELATED APPLICATIONS

The application claims the benefit of U.S. Provisional Patent Application No. 61/699,244, filed Sep. 10, 2012, the entire content of which is hereby incorporated herein by reference.

BACKGROUND OF THE INVENTION

This invention relates generally to crossbows and more specifically to a self-aligning interface between attached parts of a crossbow.

Crossbows are generally known in the art. Crossbows typically include a bow assembly portion mounted on a stock portion. The stock portion typically includes a string latch and trigger assembly for holding a drawn crossbow string and selectively releasing it.

Proper alignment between the stock portion and bow assembly portion is important to achieve the full performance of the crossbow.

There remains a need for novel structures that help to achieve proper alignment between connected portions of a crossbow.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, a crossbow comprises a bow portion defining a first central vertical axis and a stock portion defining a second central vertical axis. The bow portion comprises an interfacing portion and the stock portion comprises a complimentary interfacing portion. The interfacing portion and the complimentary interfacing portion are arranged to provide self-alignment of the stock portion with the bow portion, such that the first central vertical axis and the second central vertical axis are coaxial.

In some embodiments, the interfacing portion comprises a first surface and a second surface, the first and second surfaces oriented at equal but opposite angles to the first central vertical axis. In some embodiments, the complimentary interfacing portion comprises a first complimentary surface and a second complimentary surface, the first and second complimentary surfaces oriented at equal but opposite angles to the second central vertical axis.

In some embodiments, the bow portion defines a first central vertical plane and the stock portion defines a second central vertical plane. The interfacing portion and the complimentary interfacing portion are arranged to provide self-alignment of the stock portion with the bow portion, such that the first central vertical plane and the second central vertical plane are coplanar.

In some embodiments, a crossbow comprises a bow portion defining a first central vertical axis and a stock portion defining a second central vertical axis. The bow portion comprises a first surface and a second surface disposed at equal but opposite angles to the first central vertical axis. The stock portion comprises a first complimentary surface and a second complimentary surface disposed at equal but opposite angles to the second central vertical axis. The first and second surfaces and the first and second complimentary surfaces are arranged to provide self-alignment of the stock portion with the bow portion, such that the first central vertical axis and the second central vertical axis are coaxial.

In some embodiments, the bow portion comprises a nocking point, which is oriented in the second central vertical plane.

In some embodiments, the bow portion comprises a cavity, and a portion of the stock is oriented in the cavity.

In some embodiments, a gap is provided between the bow portion and the stock portion, which is located between the first surface and the second surface. In some embodiments, a portion of a fastener is oriented in the gap.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
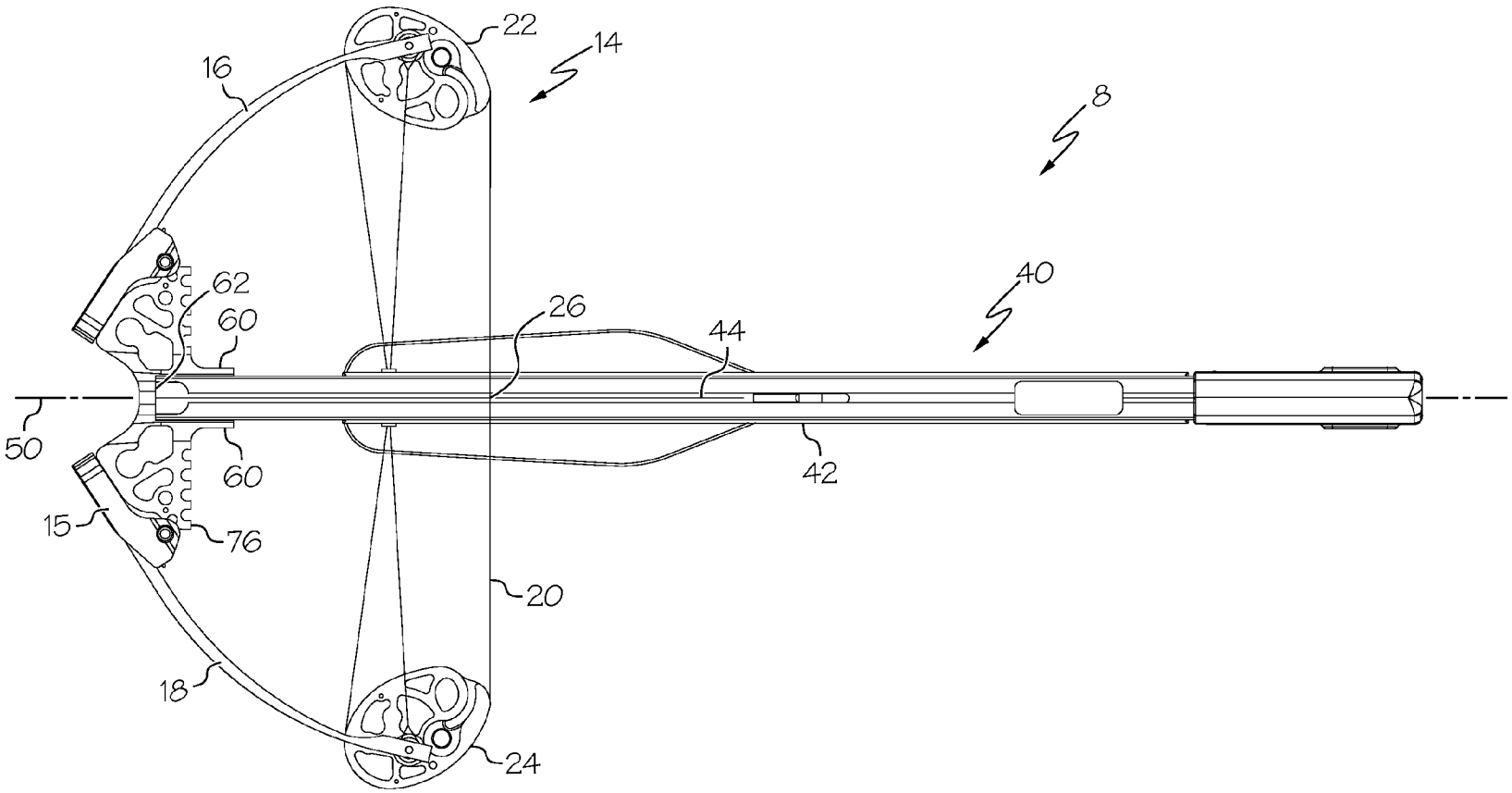
FIG. 1 shows a top view of an embodiment of a crossbow.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

Figure 2:
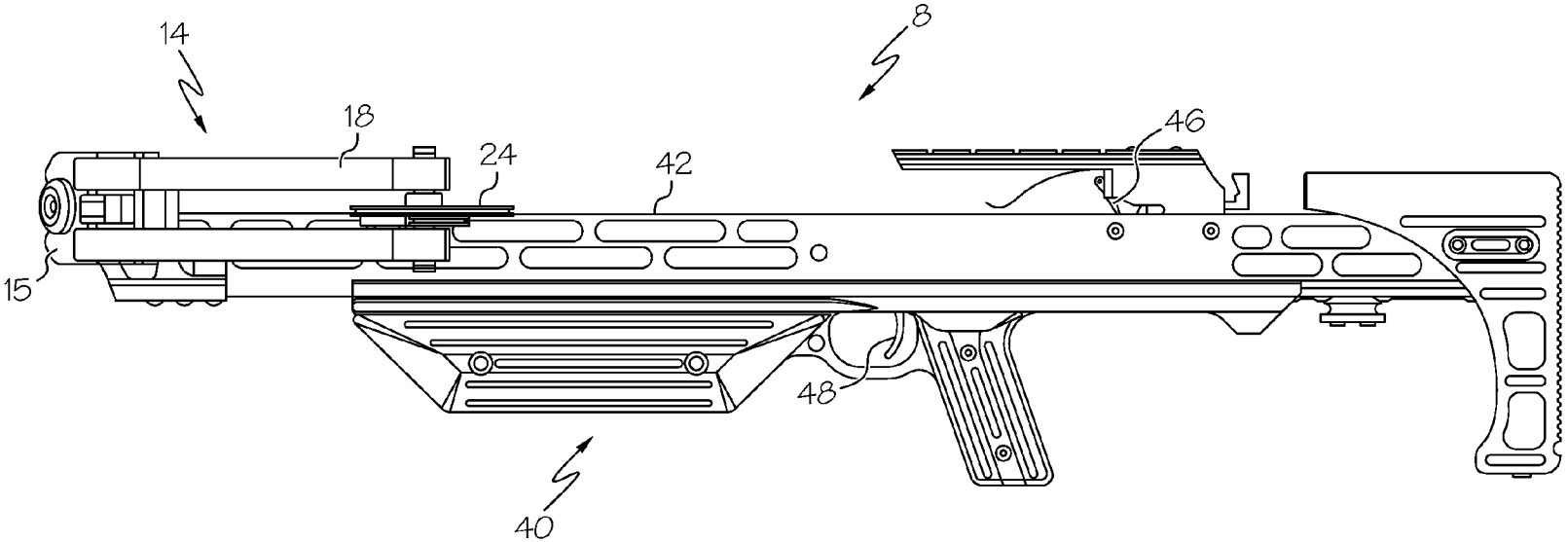
FIG. 2 shows a side view of an embodiment of a crossbow.

FIGS. 1 and 2 show an embodiment of a crossbow 8. In some embodiments, a crossbow 8 comprises a bow portion 14 and a stock portion 40, which are securely attached to one another.

The bow portion 14 desirably comprises a bow structure having a bowstring 20 that can be drawn, thus causing limbs 16, 18 to flex and store energy. In some embodiments, the bow portion 14 comprises a compound bow, for example having rotatable members 22, 24 and at least one power cable 21. As illustrated, the bow portion 14 comprises a dual cam bow having two power cables 21 and mirrored rotatable members 22, 24, wherein each rotatable member 22, 24 comprises a cam. In some embodiments, a bow portion 14 comprises a non-compounding bow, such as a recurve bow.

In some embodiments, a bow portion 14 comprises a structural riser member that supports the limbs 16, 18. In some embodiments, a riser member comprises a prod 10 as shown in the Figures. In some embodiments, the prod 10 comprises a structural portion of the bow portion 14 and further comprises an interface portion configured for attachment to the stock portion 40.

In some embodiments, a bow portion 14 comprises limb cups 15, for example as disclosed in U.S. Pat. No. 8,453,635, the entire disclosure of which is hereby incorporated herein in its entirety. A limb cup 15 can attach between a prod 10 and a limb 16, 18.

In some embodiments, a prod 10 comprises a tread portion 76 arranged to be stepped upon, for example as disclosed in US Provisional Application No. 61/699,197, filed Sep. 10, 2012, the entire disclosure of which is hereby incorporated herein by reference. A tread portion 76 can comprise a treaded surface, such as a plurality of treads separated by gaps. In some embodiments, a plurality of treads are arranged in a similar plane that extends on both sides of a longitudinal axis 50. In some embodiments, the tread portion 76 provides a step to be stepped upon when the crossbow 8 is being drawn.

The stock portion 40 desirably comprises a rail 42 that extends in a lengthwise direction of the crossbow 8, a latch 46 and a trigger 48. When the crossbow is drawn, the latch 46 retains the bowstring 20 in the drawn configuration. The trigger 48 is configured to release the latch, thus causing the crossbow to fire.

The crossbow 8 defines a longitudinal axis 50, which can also be considered a shooting axis. An arrow or bolt (not illustrated) fired by the crossbow 8 desirably travels along the longitudinal axis 50. Desirably, the rail 42 extends along the longitudinal axis 50. In some embodiments, the rail 42 comprises a longitudinal groove 44. An arrow or bolt being fired by the crossbow 8 can rest on or in the groove 44, and may travel along the groove 44 during firing. Desirably, a central axis of a bolt resting in the groove 44 is aligned upon the longitudinal axis 50 (e.g. aligned as shown in FIG. 1). For example, the central axis of a bolt resting in the groove 44 is desirably coaxial with the longitudinal axis 50.

It is desirable for the bow portion 14 to be properly aligned with the stock portion 40. As the bow portion 14 provides the force to propel a bolt, and the stock portion 40 provides a groove to help direct the bolt's travel path, it is desirable for the bow portion 14 to be properly oriented with respect to the longitudinal axis 50. For example, a nocking point 26 on the bowstring 20 desirably travels along the longitudinal axis 50. In some embodiments, portions of the bow portion 14 comprise mirror images of one another across the longitudinal axis 50. For example, the prod 10 can be symmetrical across the longitudinal axis 50, and the first limb 16 can be symmetrical with the second limb 18 across the longitudinal axis 50. Desirably, the bow portion 14 is both laterally and rotationally aligned with the stock portion 40.

Figure 3:
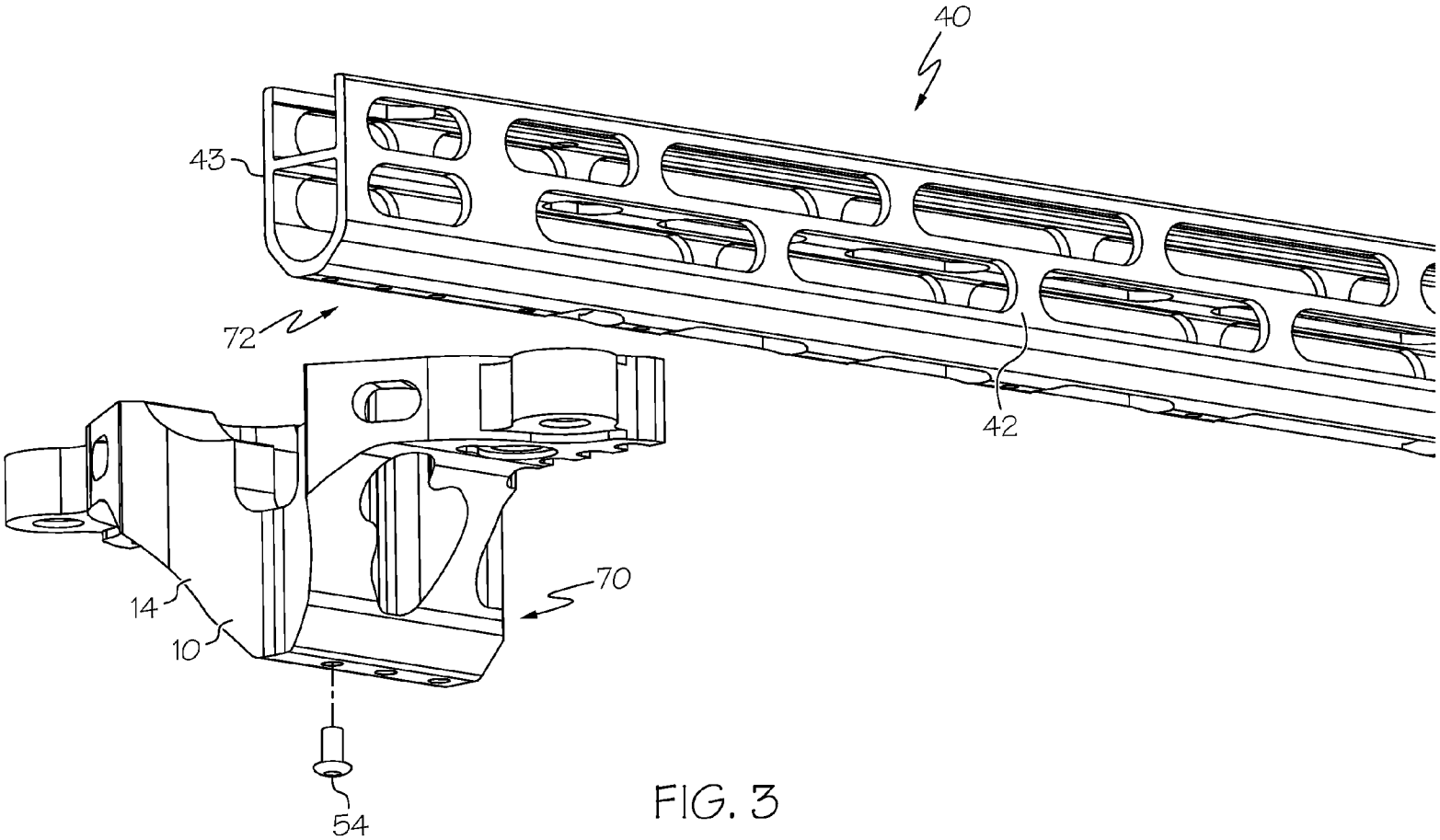
FIG. 3 shows an embodiment of a crossbow prod and mating stock portion.
Figure 4:
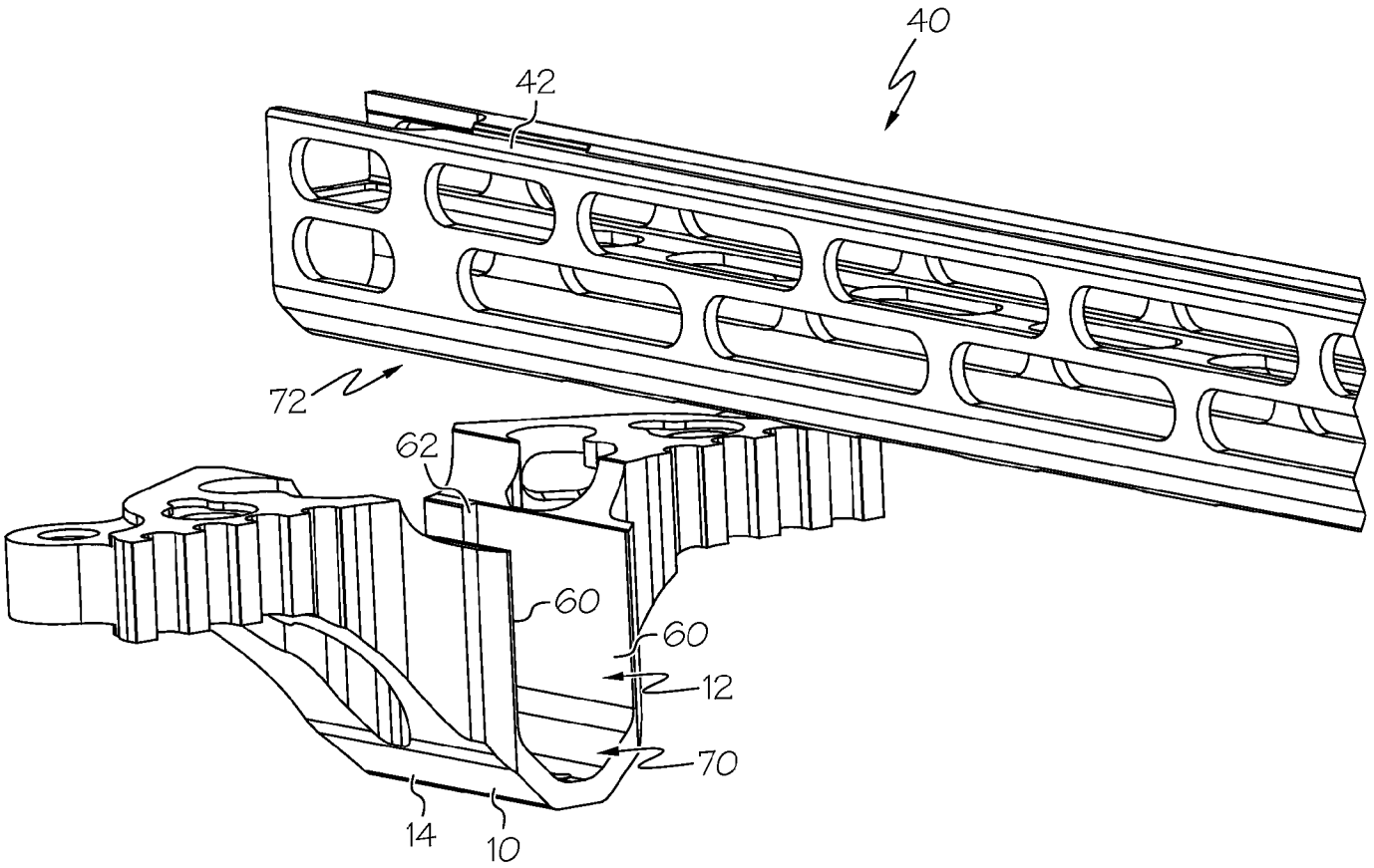
FIG. 4 shows another view of a crossbow prod.

FIGS. 3 and 4 each show an embodiment of a prod 10 (e.g. a portion of a bow portion 14) having an interfacing structure 70 arranged to self-align with a complimentary interfacing surface 72 of a stock portion 40. FIG. 3 shows the stock 40 and complimentary interfacing surface 72 in better detail, and FIG. 4 shows the prod 10 and interfacing structure 70 in better detail. In some embodiments, a prod 10 comprises an interfacing surface 70 arranged to self-align with a complimentary interfacing surface of a rail 42.

In some embodiments, a first crossbow portion comprises a cavity 12 and a second crossbow portion can be received in the cavity 12. For example, in some embodiments, a prod 10 defines a cavity 12, and portion of a rail 42 can be received in the cavity 12. In some embodiments, the cavity 12 is defined by sidewalls 60. In some embodiments, the cavity 12 is at least partially defined by a back wall 62 (see also FIG. 1). In some embodiments, an end 43 of the rail 42 abuts the back wall 62 portion of the cavity 12.

Desirably, the portions 14, 40 comprise complimentary mating surfaces that are arranged to self-align as pressure between the portions 14, 40 increases (e.g. as a fastener 54 is tightened). In some embodiments, each portion 14, 40 comprises angled surfaces that are oriented to cause self-alignment.

Figure 5:
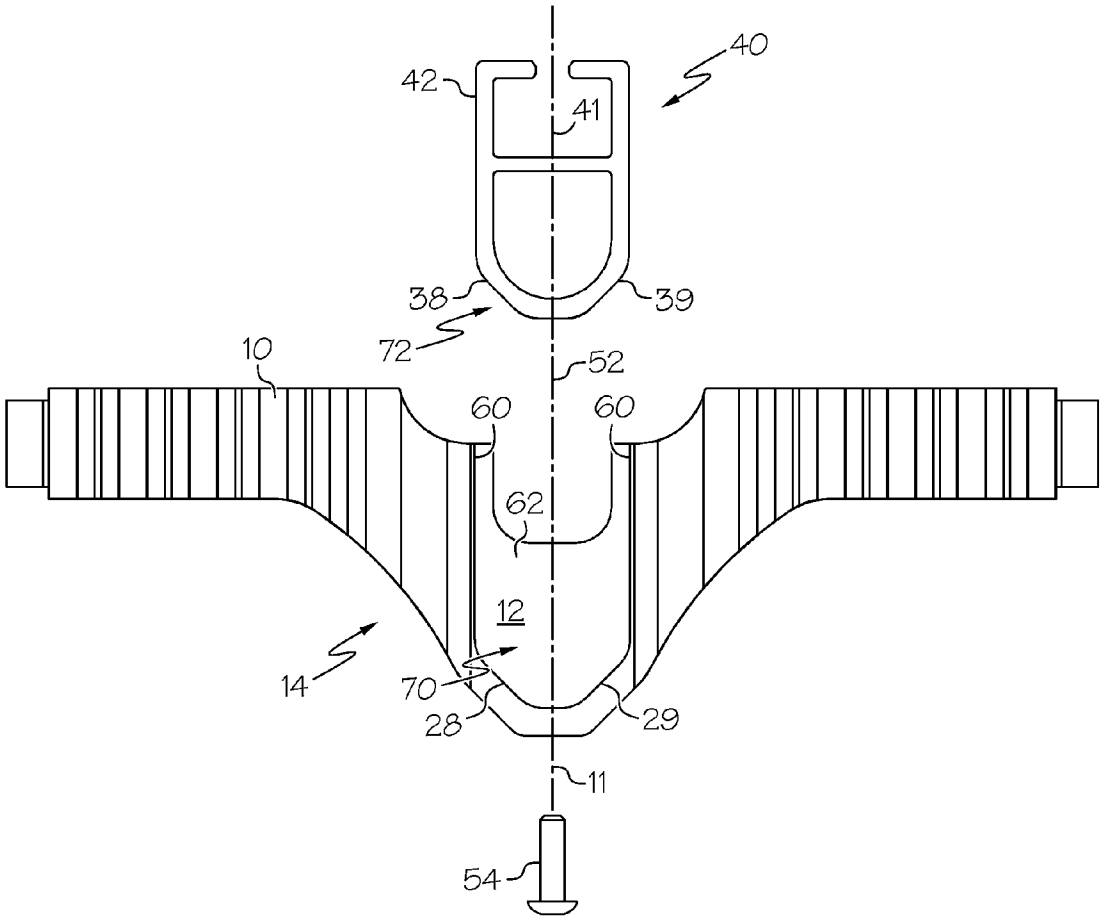
FIG. 5 shows an exploded view of a crossbow prod and mating stock portion.
Figure 6:
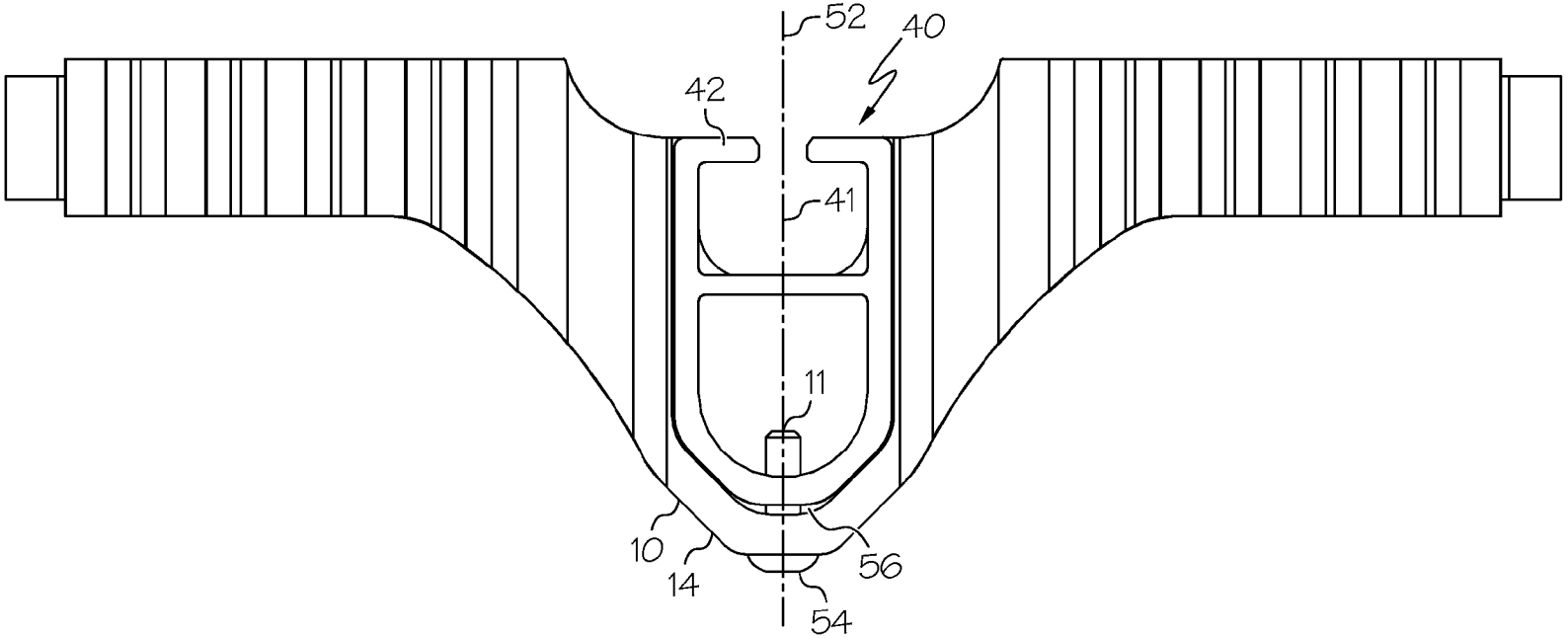
FIG. 6 shows a cross-sectional view of an embodiment of a crossbow prod and mating stock portion in an attached configuration.

FIGS. 5 and 6 show embodiments of first and second portions 14, 40 with self-aligning, complimentary mating surfaces 70, 72 in greater detail. In some embodiments, a bow portion 14 comprises a first surface 28 and a second surface 29 designed to abut portions of the stock portion 40. Desirably, the stock portion 40 comprises a first surface 38 and a second surface 39 designed to abut portions of the bow portion 14. For example, in some embodiments, the first surface 28 of the bow portion 14 abuts the first surface 38 of the stock portion 40, and the second surface 29 of the bow portion 14 abuts the second surface 39 of the stock portion 40. In some embodiments, the first and second surfaces 28, 29 comprise the interfacing structure 70 of the bow portion 14, and the first and second surfaces 38, 39 comprise the complimentary interfacing structure 72 of the stock portion 40.

In some embodiments, the first and second surfaces 28, 29 comprise walls that define the cavity 12. In some embodiments, the first and second surfaces 28, 29 are disposed on opposite sides of a central vertical axis 11 of the bow portion 14. In some embodiments, the first surface 28 is symmetrical with the second surface 29 across the central vertical axis 11 of the bow portion 14. In some embodiments, the first and second surfaces 28, 29 are disposed at equal but opposite angles to the central vertical axis 11. As shown in FIG. 5, the first and second surfaces 28, 29 are each disposed at 45 degrees to the central vertical axis 11.

In some embodiments, the first and second surfaces 38, 39 of the stock portion comprise external surfaces of the rail 42.

Desirably, the first and second surfaces 38, 39 of the stock portion 40 are configured similarly to the first and second surfaces 28, 29 of the bow portion 14. Thus, in some embodiments, first and second surfaces 38, 39 are disposed on opposite sides of a central vertical axis 41 (or a central vertical plane) of the stock portion 40. In some embodiments, the first surface 38 is symmetrical with the second surface 39 across the central vertical axis 41 (or a central vertical plane) of the stock portion 40. In some embodiments, the first and second surfaces 38, 39 are disposed at equal but opposite angles to the central vertical axis 41. As shown in FIG. 5, the first and second surfaces 38, 39 are each disposed at 45 degrees to the central vertical axis 41. Desirably, the respective first and second surfaces 38, 39 of the stock portion 40 are arranged at similar angles to vertical as the respective first and second surfaces 28, 29 of the bow portion 14 to allow abutting and self-alignment—thus, the respective surfaces 38, 39 are considered complimentary to the respective surfaces 28, 29.

In some embodiments, the portions 28, 29, 38, 39 are each flat, or each comprise a flat or planar portion. In some embodiments, the portions 28, 29, 38, 39 can include curvature.

The arrangement of angled surfaces 28, 29 of the bow portion 14 abutting the angled surfaces 38, 39 of the stock portion 40 causes the stock portion 40 to self-align with the bow portion 14, wherein the central vertical axis 11 (or a central vertical plane) of the bow portion 14 and the central vertical axis 41 (or a central vertical plane) of the stock portion 40 become coaxial (or coplanar).

Desirably, the bow portion 14 (e.g. prod 10) is fixedly attached to the stock portion 40 (e.g. rail 42) using any suitable method. In some embodiments, the portions 14, 40 are attached with one or more fasteners 54. For example, a fastener 54 can pass through one portion (e.g. 14) and engage the other portion (e.g. 40). In some embodiments, the portions 14, 40 are attached with a suitable adhesive, glue, cement, epoxy, etc., wherein the surfaces 28, 29 can be adhered to the complimentary surfaces 38, 39. In some embodiments, the portions 14, 40 are attached by welding, brazing, ultrasonic or high-frequency welding (e.g. depending on the materials), etc.

FIG. 6 shows the bow portion 14 attached to the stock portion 40 in proper alignment. Desirably, the first and second surfaces 28, 29 of the bow portion 14 are held tightly against the first and second surfaces 38, 39 of the stock portion 40.

In some embodiments, a gap 56 remains between the bow portion 14 and stock portion 40 when the portions 14, 40 are properly abutted. In some embodiments, the gap 56 is oriented between the first surfaces 28, 38 and the second surfaces 29, 39. A gap 56 ensures proper contact between the self-aligning interfacing surfaces of the bow portion 14 and stock portion 40. In some embodiments, a portion of a fastener 54 extends through the gap 56.

Desirably, each surface 28, 29, 38, 39 extends along a length of the crossbow 8. In some embodiments, a length of a surface 28, 29, 38, 39 exceeds its width. This ensures that the bow portion 14 is not only laterally aligned with the stock portion 40, but rotationally aligned as well. For example, axis 11 and axis 41 as shown in FIG. 5 can also represent central vertical planes of the bow portion 14 and stock portion 40, respectively. When the bow portion 14 is rotationally aligned with the stock portion 40, the central vertical planes (e.g. 11, 41) are coplanar.

The angled surfaces 28, 29, 38, 39 can each be oriented at any suitable angle provided they remain arranged to interface and cause self-alignment. For example, a surface (e.g. 28) could be oriented at anywhere from just over zero degrees to just under ninety degrees to a vertical axis (e.g. 11). More desirably, a surface (e.g. 28) is oriented in the range of thirty to sixty degrees to a vertical axis (e.g. 11). The complimentary surface 38 that abuts the surface 28 is desirably disposed at a similar angle to vertical.

Further, a first angled surface (e.g. 28) need not be oriented at an angle that is equal to the angle of a second angled surface (e.g. 29). In some embodiments, the first surfaces 28, 38 can be provided at a first angle and the second surfaces 29, 39 can be provided at a second angle that is different from the first angle. So long as the first surfaces 28, 38 are oriented at similar angles to vertical, and the second surfaces 29, 39 are oriented at similar angles to vertical, the first surfaces 28, 38 can be oriented at a different angle from the second surfaces 29, 39, and the interface will still provide for self-alignment.

Desirably, the bow portion 14 and stock portion 40 define an interfacing axis 52. The portions 14, 40 will move with respect to one another along the interfacing axis 52, as the portions 14, 40 are fastened (e.g. as a fastener 54 is tightened). In some embodiments, the interfacing axis 52 is oriented vertically. In some embodiments, the interfacing axis 52 is oriented orthogonal to a longitudinal axis 50 of the crossbow 8.

In some embodiments, reference lines extending from the surfaces 28, 29 are arranged to intersect upon the central vertical axis 11. In some embodiments, reference lines extending from the surfaces 38, 39 are arranged to intersect upon the central vertical axis 41.

With reference to FIG. 1, the bow portion 14 includes the nocking point 26, which is desirably centered upon the bow portion 14. It is desirable for the nocking point 26 to travel along the longitudinal axis 50. Proper alignment of the bow portion 14 and the stock portion 40 allows for proper placement of the nocking point 26 with respect to the stock portion 40.

Figure 7:
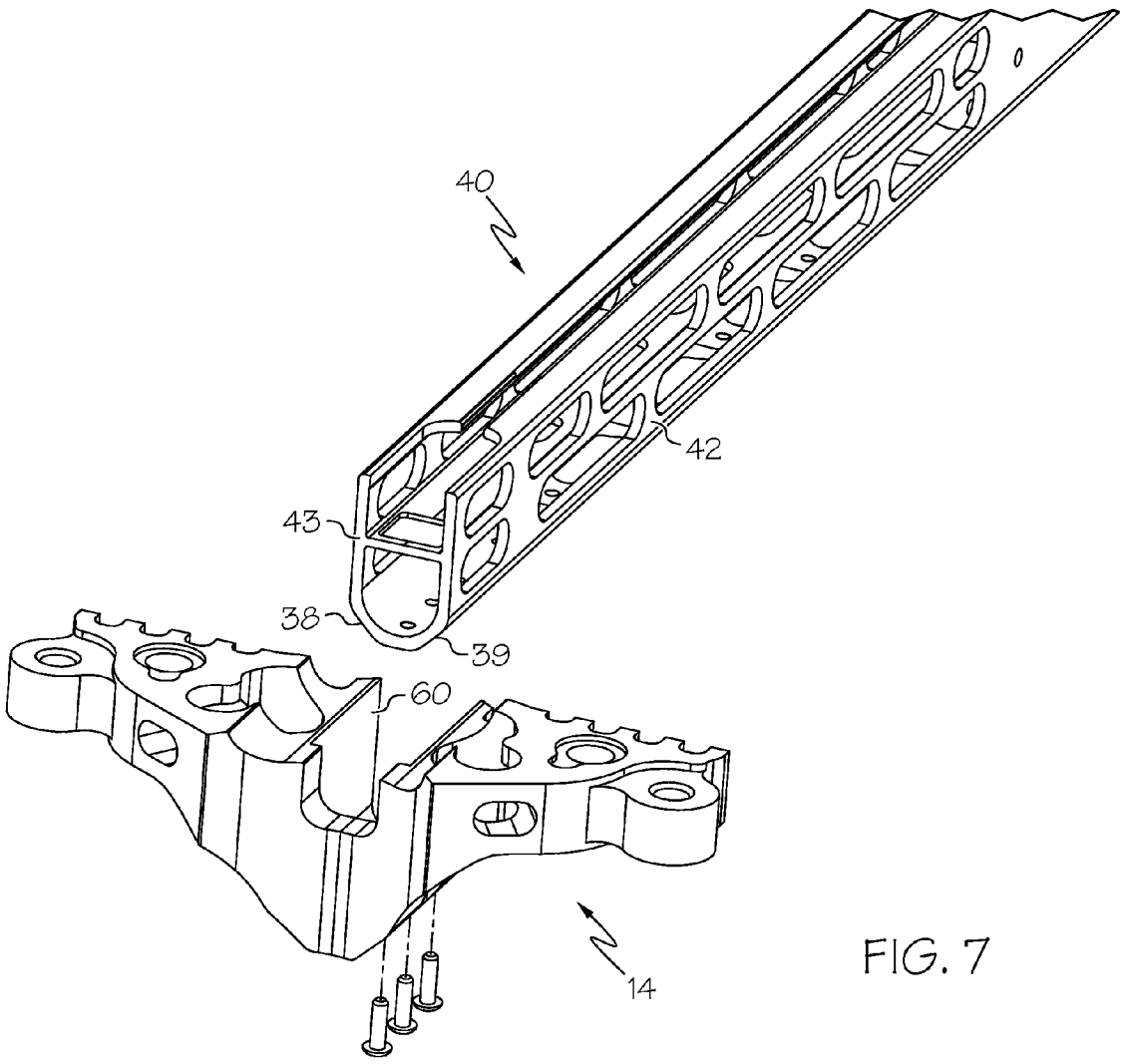
FIGS. 7 and 8 show views of an embodiment of a stock portion and a bow portion.
Figure 8:
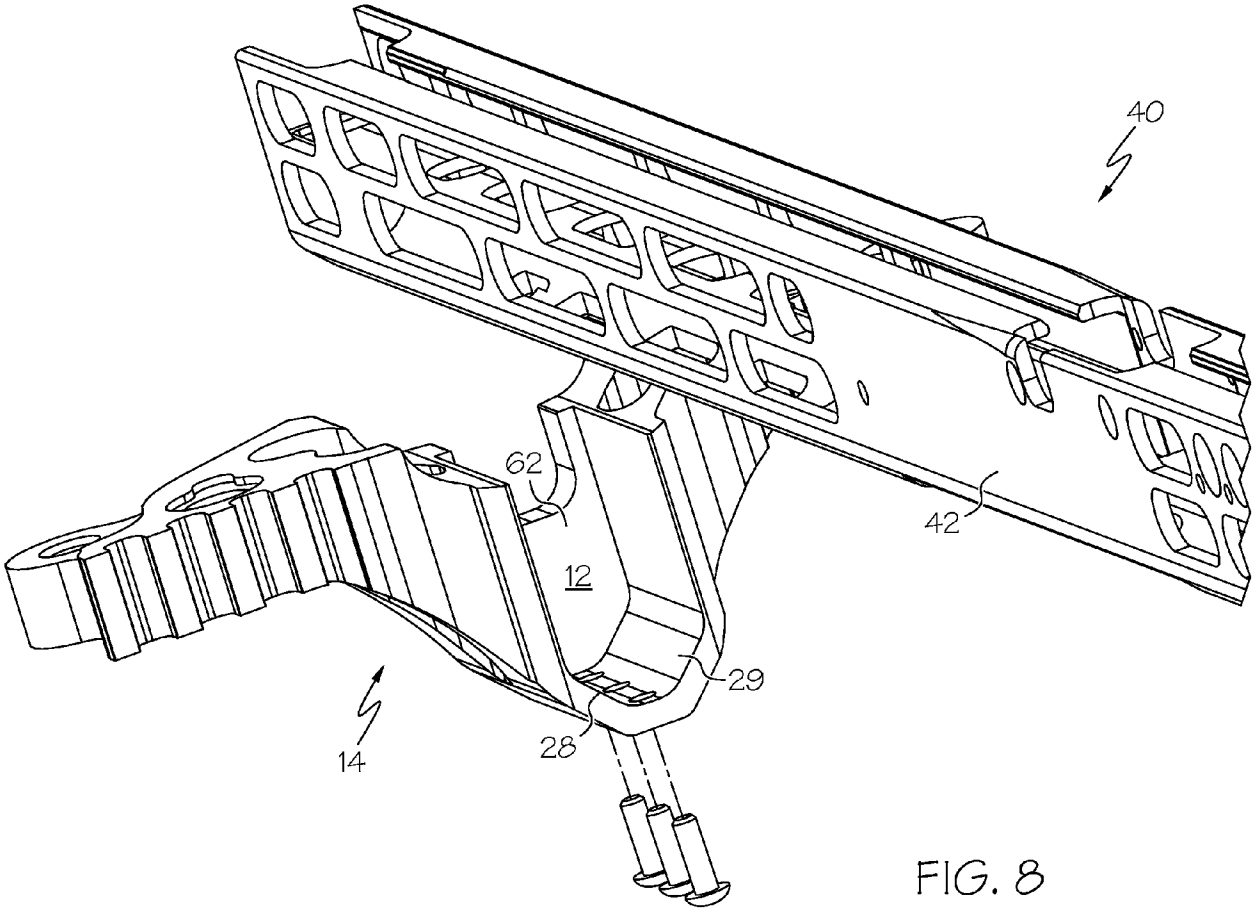
Figure 9:
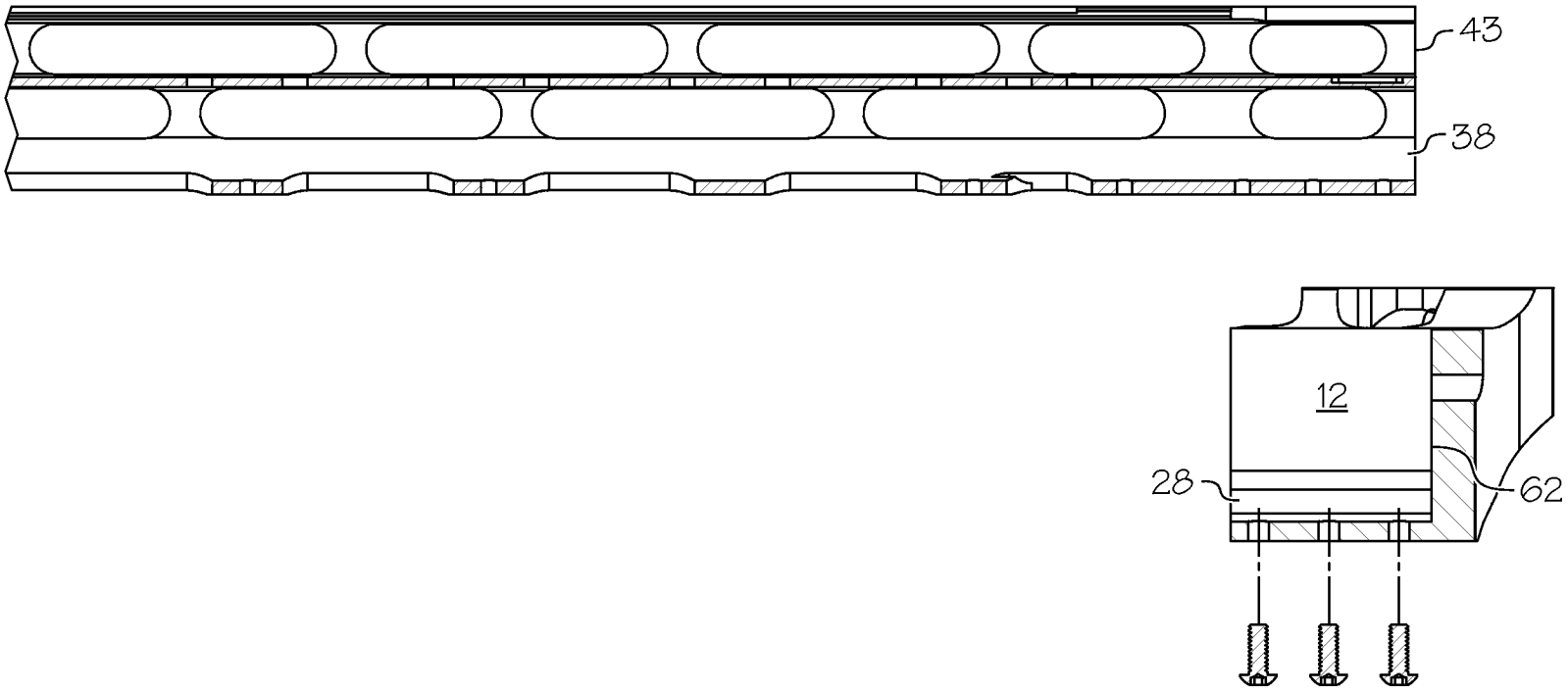
FIG. 9 shows cross-sectional drawings of an embodiment of a stock portion and a bow portion.
Figure 10:
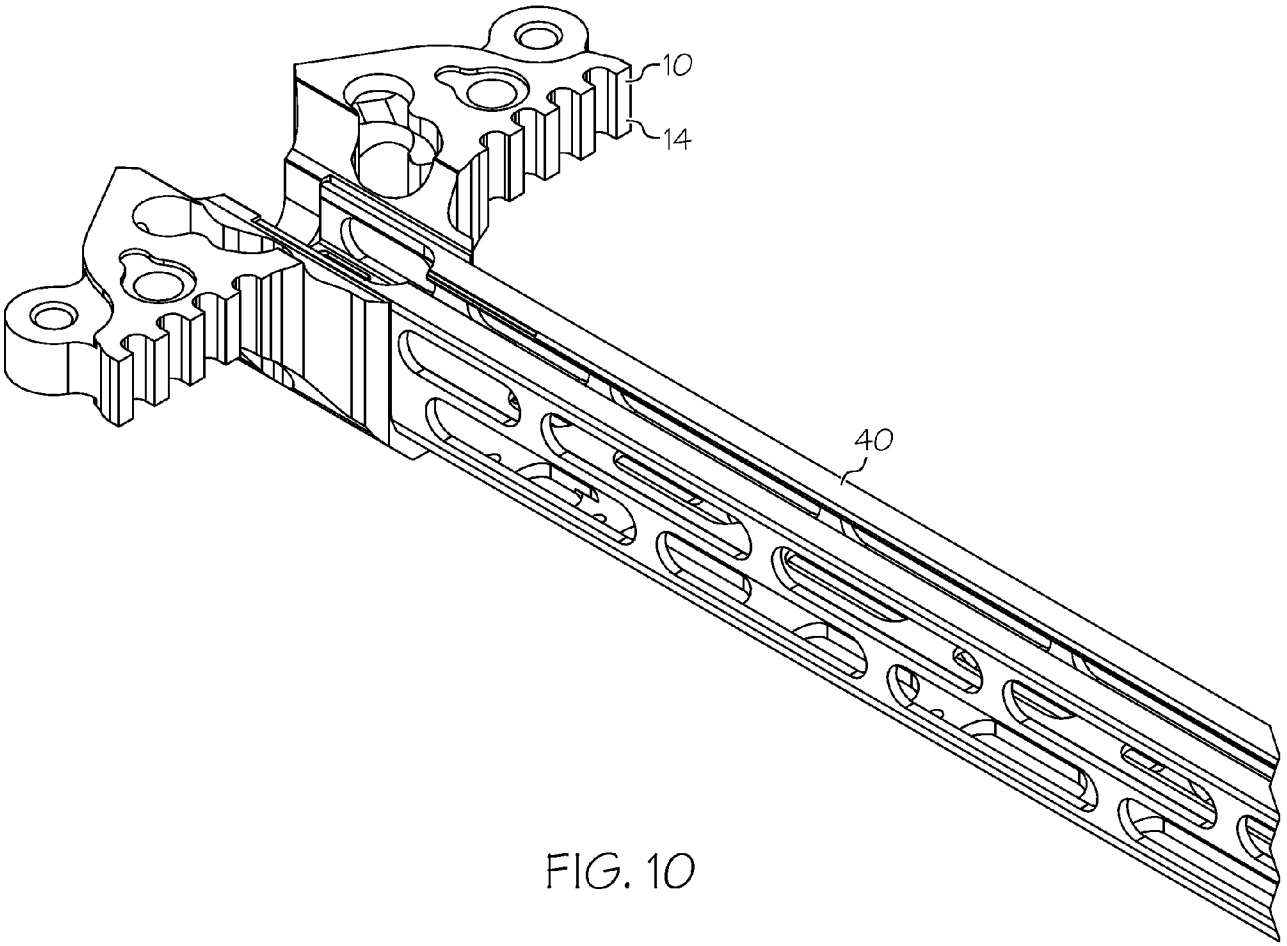
FIG. 10 shows a prod and stock engaged to one another.

FIGS. 7 and 8 show additional views of an embodiment of a stock portion 40 and an embodiment of a bow portion 14. FIG. 9 shows sectional views of an embodiment of a stock portion 40 and an embodiment of a bow portion 14.

The self-aligning interface as described herein can be used on any suitable portion of a bow wherein alignment is desired between two portions. For example, a stock portion 40 as described herein can be provided, and accessories having a complimentary self-aligning shape can be provided. In some embodiments, any accessory mounting location can include a self-aligning interfacing portion, and an accessory comprises a complimentary self-aligning interfacing portion. The self-aligning interface attachment configuration can be provided for any suitable accessory, such as quivers, sights, cocking mechanisms, dampers, etc.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A crossbow comprising:

a bow portion defining a first central vertical axis, said bow portion comprising an interfacing portion comprising a first surface and a second surface, said bow portion comprising a first connecting portion attached between said first surface and said second surface; and a stock portion defining a second central vertical axis, said stock portion comprising a complimentary interfacing portion comprising a first complimentary surface and a second complimentary surface, said stock portion comprising a second connecting portion attached between said first complimentary surface and said second complimentary surface;

wherein said interfacing portion and said complimentary interfacing portion are arranged to provide self-alignment of the stock portion with the bow portion such that the first central vertical axis and the second central vertical axis are coaxial, and a gap remains between said first connecting portion and said second connecting portion when said bow portion is attached to said stock portion and said interfacing portion contacts said complimentary interfacing portion.

2. The crossbow of claim 1, said bow portion defining a first central vertical plane, said stock portion defining a second central vertical plane, wherein said interfacing portion and said complimentary interfacing portion are arranged to provide self-alignment of the stock portion with the bow portion such that the first central vertical plane and the second central vertical plane are coplanar.

3. The crossbow of claim 1, each of said first and second surfaces oriented at an angle to said first central vertical axis.

4. The crossbow of claim 3, wherein said first and second surfaces are oriented at equal but opposite angles to said first central vertical axis.

5. The crossbow of claim 3, each of said first and second complimentary surfaces oriented at an angle to said second central vertical axis.

6. The crossbow of claim 5, wherein said first and second complimentary surfaces are oriented at equal but opposite angles to said second central vertical axis.

7. The crossbow of claim 5, wherein the first surface abuts the first complimentary surface and the second surface abuts the second complimentary surface.

8. The crossbow of claim 1, comprising a fastener attaching said bow portion to said stock portion, wherein a portion of said fastener is oriented in said gap.

9. The crossbow of claim 1, wherein said bow portion comprises a cavity and a portion of said stock portion is oriented in said cavity.

10. The crossbow of claim 9, wherein said interfacing portion at least partially defines said cavity.

11. A crossbow comprising:

a bow portion defining a first central vertical axis, said bow portion comprising a first planar surface and a second planar surface disposed at equal but opposite angles to said first central vertical axis;

a stock portion defining a second central vertical axis, said stock portion comprising a first complimentary surface and a second complimentary surface disposed at equal but opposite angles to said second central vertical axis; and a gap between said bow portion and said stock portion, said gap located between said first planar surface and said second planar surface;

wherein said first and second planar surfaces and said first and second complimentary surfaces are arranged to provide self-alignment of the stock portion with the bow portion such that the first central vertical axis and the second central vertical axis are coaxial.

12. The crossbow of claim 11, said bow portion defining a first central vertical plane, said stock portion defining a second central vertical plane, wherein said first and second surfaces and said first and second complimentary surfaces are arranged to provide self-alignment of the stock portion with the bow portion such that the first central vertical plane and the second central vertical plane are coplanar.

13. The crossbow of claim 12, wherein said bow portion comprises a nocking point, said nocking point oriented in said second central vertical plane.

14. The crossbow of claim 11, wherein said bow portion comprises a cavity and a portion of said stock portion is oriented in said cavity.

15. The crossbow of claim 14, wherein said first planar surface and said second planar surface at least partially define said cavity.

16. The crossbow of claim 11, wherein said first planar surface abuts said first complimentary surface and said second planar surface abuts said second complimentary surface.

17. The crossbow of claim 11, said first central vertical axis extending through said gap.

18. The crossbow of claim 11, comprising a fastener attaching said bow portion to said stock portion, wherein a portion of said fastener is oriented in said gap.

19. The crossbow of claim 11, wherein said first complimentary surface and said second complimentary surface comprise exterior surfaces of said stock portion.

20. A crossbow comprising:

a bow portion defining a first central vertical plane, said bow portion comprising a first surface and a second surface disposed at equal but opposite angles to said first central vertical plane, said first surface and said second surface each having a length that extends parallel to said first central vertical plane;

a stock portion defining a second central vertical plane, said stock portion comprising a first complimentary surface and a second complimentary surface disposed at equal but opposite angles to said second central vertical plane, said first complimentary surface and said second complimentary surface each having a length that extends parallel to said second central vertical plane; and a gap between said bow portion and said stock portion, said first central vertical plane extending through said gap;

wherein said first and second surfaces and said first and second complimentary surfaces are arranged to provide self-alignment of the stock portion with the bow portion such that the first central vertical plane and the second central vertical plane are coplanar.

* * * * *